US005273375A

United States Patent [19]

Plourde

[11] Patent Number: 5,273,375

[45] Date of Patent: Dec. 28, 1993

[54] TRENCH PAVING DEVICE

[76] Inventor: Jean G. Plourde, 30 Canterbury La., Plainville, Conn. 06062

[21] Appl. No.: 901,721

[22] Filed: Jun. 22, 1992

[51] Int. Cl.[5] ..... E01C 19/00; E02F 3/76

[52] U.S. Cl. ..... 404/118; 37/403; 37/444; 37/903

[58] Field of Search ..... 404/118, 119; 37/117.5, 37/DIG. 3, DIG. 12, 80 A, 80 R, 103, 118 A

[56] References Cited

U.S. PATENT DOCUMENTS

| | | | |
|---|---|---|---|
| 791,726 | 6/1905 | Schutte . | |
| 1,487,454 | 3/1924 | Gardiner . | |
| 2,076,890 | 4/1937 | Heltzel . | |
| 2,664,794 | 1/1954 | Evans . | |
| 2,902,910 | 9/1959 | Malsbury et al. . | |
| 3,108,517 | 10/1963 | Fingland . | |
| 3,797,953 | 3/1974 | Undskog | 404/103 |
| 4,320,988 | 3/1982 | Seal | 404/118 |
| 4,322,178 | 3/1982 | Lee | 37/DIG. 12 X |
| 4,329,081 | 5/1982 | Buvik | 404/110 |
| 4,492,490 | 1/1985 | Christine et al. | 404/108 |
| 4,597,205 | 7/1986 | Guest | 37/117.5 X |
| 4,609,303 | 9/1986 | Shumaker | 404/105 |
| 4,861,188 | 8/1989 | Rouillard | 404/75 |
| 4,936,392 | 6/1990 | Kitchin | 37/117.5 X |

*Primary Examiner*—William P. Neuder
*Attorney, Agent, or Firm*—McCormick, Paulding & Huber

[57] ABSTRACT

A trench paving device releasably secured to the lower lip of an earth moving bucket on a front end loader. The paving device has a pair of opposing vertically disposed and rearwardly converging side plates and a vertically adjustable screed supported between the rear end portions of the side plates. Skids carried by and projecting outwardly from the side plates support the paving device in straddling relation to a trench to be paved. The paving device moves with the bucket and relative to the front end loader in response to operation of a manually operable control system on the front end loader.

16 Claims, 2 Drawing Sheets

TRENCH PAVING DEVICE

BACKGROUND OF THE INVENTION

This invention relates in general to paving equipment and deals more particularly with a trench paving device for attachment to a construction vehicle of the type having a moveable tool, such as an earth moving bucket, mounted at its front end of the vehicle and manually operable controls carried by the vehicle for moving the tool to and retaining it in selected orientation relative to the vehicle.

In laying underground utilities, such as gas lines, water lines and electrical service, it is often necessary to cut a narrow trench in an existing pavement. After the utility line has been installed the trench is back filled to a level somewhat below the grade level of the existing pavement. Commencing within the trench paving material is then spread to form successive rises, the level of the final rise being somewhat above the grade level of the existing pavement. The trench paving operation is completed by rolling the paving material to existing grade level.

Presently available paving machines are relatively large, expensive, require special hauling equipment to transport to and from a job site and are usually considerably larger than normally required for an average trench paving job. Heretofore paving devices have been provided for use with construction vehicles. However, such paving devices are generally adapted to be towed behind a vehicle, are difficult to maneuver and present troublesome steering problems when used in paving a narrow trench. Consequently, trench paving operations are often performed almost entirely with manual labor, the paving material deposited within the trench being spread by manual raking.

It is the general aim of the present invention to provide an improved compact, durable trench paving device which may be readily attached to and removed from an existing tool, such as an earth moving bucket, mounted at the front of a construction vehicle and moved relative to the vehicle by a manually operable control system carried by the vehicle. It is a further aim of the invention to provide a trench paving attachment which may be transported to and from a job site without the need for special hauling or transporting equipment.

SUMMARY OF THE INVENTION

In accordance with the present invention a trench paving device is provided which has a body assembly formed by a pair of opposing sidewalls and supporting means for maintaining the sidewalls in generally vertically disposed and rearwardly converging position relative to each other with the bottom edges of the sidewalls disposed within a generally common horizontal plane. The body assembly further includes ground engaging means for supporting the paver body in straddling relation to a trench to be paved. A screed having a lateral dimension approximating the width dimension of a trench to be paved is mounted between the rear end portions of the sidewalls for vertical adjustment relative to the sidewalls between raised positions wherein the lower edge of the screed plate is disposed above the common plane and lowered positions wherein the lower edge of the plate is disposed below the common horizontal plane. Clamping means releasably retain the screed plate in a desired position of vertical adjustment relative to the sidewalls. A means is provided for releasably securing the device in fixed position to a tool mounted on and at the front of a construction vehicle to move with the tool and relative to the vehicle in response to a manually, operated control system carried by the vehicle.

DETAILED DESCRIPTION OF PREFERRED EMBODIMENT

Figure 1:
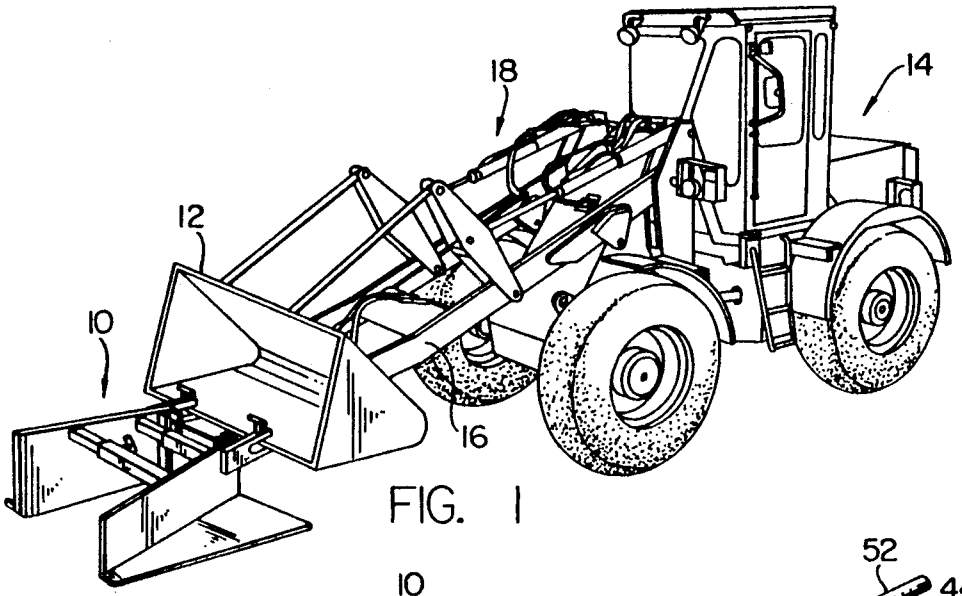
FIG. 1 is a perspective view of a trench paving device embodying the present invention and shown secured to an earth moving bucket mounted at the front end of a construction vehicle or front end loader.
Figure 2:
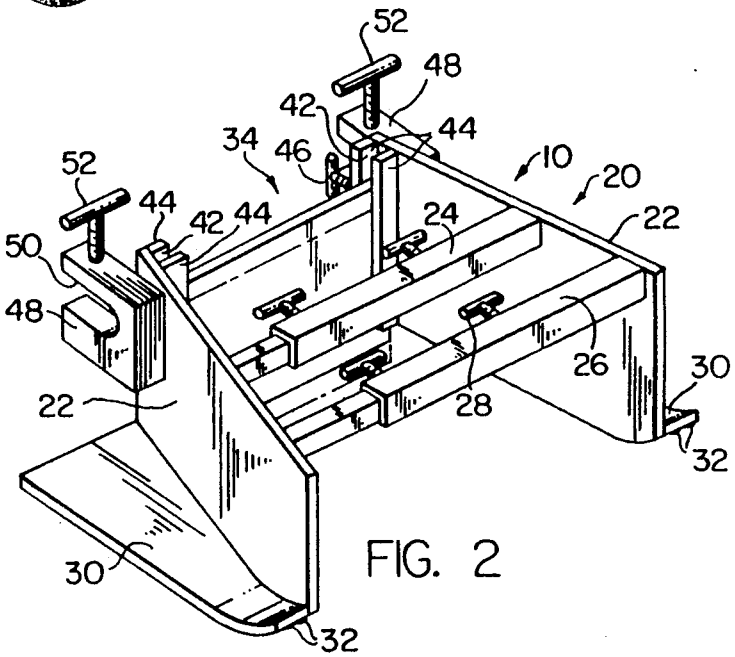
FIG. 2 is a somewhat enlarged perspective view of the paving device shown in FIG. 1.
Figure 7:
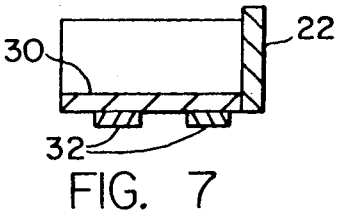
FIG. 7 is a sectional view taken along the line 7—7 of FIG. 4.

In the drawings and in the description which follows a trench paving device embodying the present invention and indicated generally by the reference numeral 10 is shown releasably secured to a tool or earth moving bucket 12 mounted at the forward end of a construction vehicle or front end loader, indicated generally by the numeral 14. The front end loader 14 has a moveable tool carrier 16 to which the bucket 12 is attached and includes a manually operable hydraulic control system, indicated generally at 18, for moving the bucket to and retaining it in a desired position of orientation relative to the loader 14.

Considering now the trench paving device 10 in further detail, it is preferably of welded steel construction and has a body assembly indicated generally at 20 which includes a pair of sidewalls 22, 22 formed by generally rectangular vertically disposed side plates. The side plates 22, 22 are supported in opposing laterally spaced apart and rearwardly converging relation to each other by a pair of telescopically adjustable support members or cross members 24 and 26. The cross members are welded or otherwise connected in fixed position to upper portions of the side plates 22, 22 in parallel relation to each other to permit the lateral spacing between the side plates to be adjusted, while maintaining the rearwardly converging relationship between the side plates. Conventional threaded clamping fasteners 28, 28 associated with the telescopic cross members 24 and 26 clampingly secure the cross members in selected positions of the adjustment.

Figure 4:
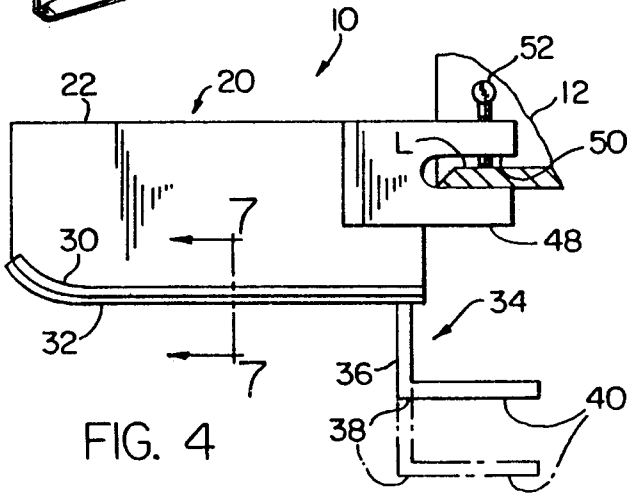
FIG. 4 is a side elevational view of the paving device.
Figure 5:
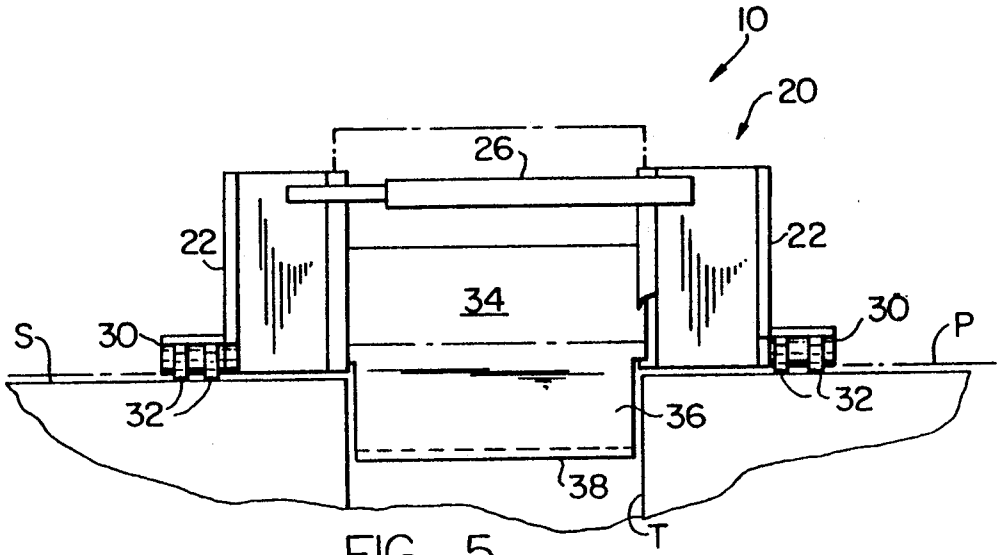
FIG. 5 is a front elevational view of the paving device.

Each side plate 22 has an associated bottom plate or skid 30 connected to and extending along its lower marginal edge and projecting outwardly from it. The skids 30, 30 have upwardly turned forward end portions and it should also be noted that the lower forward edges of the side plates 22, 22 are contoured to substantially complement the forward ends of the skids, as best shown in FIG. 4. The bottom surfaces of the skids 30, 30 and the bottom edges of the side plates 22, 22 lie within a common horizontal plane, as best shown in FIG. 5.

At least one wear strip 32 is welded or otherwise suitably secured to the bottom surface of each skid 30.

Figure 6:
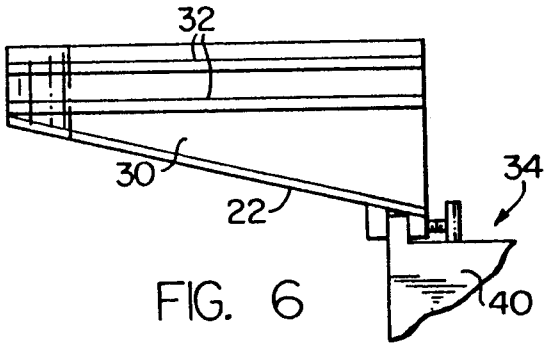
FIG. 6 is a fragmentary bottom plan view of the paving device.
Figure 3:
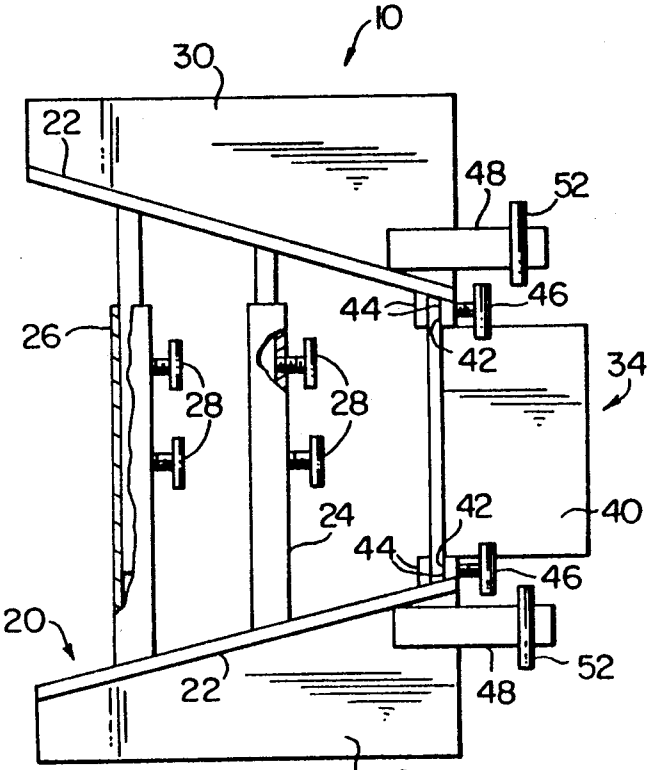
FIG. 3 is a top plan view of the trench paving device of FIG. 1.

The illustrated embodiment 10 has two such wear strips welded to the bottom surface of each skid 30 and extending from the front to the rear of the skid, as best shown in FIG. 6. The wear strips 32, 32 are made from a material harder than the material from which the skids 30, 30 are made.

The trench paving device 10 further includes a vertically adjustable screed indicated generally at 34 and supported by and between the side plates 22, 22. The screed 34 essentially comprises a vertically disposed rectangular plate 36 which has a generally horizontal lower edge 38. However, the presently preferred screed 34 also has a horizontally disposed portion 40 which extends rearwardly from the lower edge 38, as best shown in FIG. 4. The screed 34 is supported within vertically disposed and inwardly open slots 42, 42 formed by the side plates 22, 22. Preferably, and as shown, the slots 42, 42 are formed by horizontally spaced apart and vertically extending metal strips 44, 44 welded to the inner surfaces of the side plates 22, 22 and extending along the rear end portions of the plates. The screed 34 has an effective lateral width dimension approximately the width of a trench to be paved and is selected from a plurality of screeds 34, 34 each having a different effective lateral width. The upper portion of the screed plate 36 has a lateral width somewhat greater than the lower portion and is received within the slots 42, 42 as best shown in FIG. 5. Clamping fasteners 46, 46 threadably engaged in openings in the strips 44, 44 clampingly engage associated marginal edge portions of the screed plate 36 within the slots 42, 42 to releasably retain the screed 34 in a position of vertical adjustment relative to the side plates 22, 22.

The arrangement for releasably securing the paving device 10 to an associated tool may vary, and will, of course, be determined by the nature of the tool to which the device is to be attached. The illustrated device 10 is shown attached to the lower lip of an associated earth moving bucket 12. The presently preferred manner of attachment is best shown in FIG. 4 where the lip of the bucket 12 is indicated by the letter L. A pair of attaching members 48, 48 are welded or otherwise secured to and outboard of the side plates 22, 22 and project rearwardly from the latter plates. Each attaching member 48 essentially comprises a rectangular metal block and has a generally rearwardly open slot 50 for receiving an associated portion of the lip L. A clamping screw 52 threadably engaged with each attaching member 48 clampingly engages the lip within the slot 50 to firmly hold the paving device on and in fixed position relative to the bucket 12 for movement with the bucket and relative to the vehicle 14 in response to operation of the manually operable control which comprise part of the hydraulic control system 18.

After a utility line has been laid in a trench, the trench is back filled to cover the utility line in preparation for paving. A screed 34 having a lateral width dimension approximating the width of the trench is selected from a plurality of screeds of differing width. The clamping fasteners 28, 28 are loosened and the lateral spacing between the side plates 22, 22 is adjusted to receive the selected screed 34 within the slots 42, 42 after which the clamping fasteners 28, 28 are tightened. The screed 34 is temporarily secured in a raised position by tightening the clamping fasteners 46, 46. The device 10 is now ready for attachment to the lip of the bucket 12. The bucket lip is positioned within the slots 50, 50 and the clamping fasteners 52, 52 are tightened to complete the assembly.

The paving device 10 is positioned in straddling relation to the trench with the skids resting on the shoulders of the trench, as shown in FIG. 5 wherein the trench is indicated by the letter T and the shoulders designated by the letters S, S. The screed 34 is adjusted to a lowered position within the trench wherein the lower edge 38 is disposed below the skids 30, 30 and at the level of the first rise within the trench T. Paving material is now deposited in the trench ahead of the device 10. Thereafter, the vehicle 14 is driven in a forward direction causing the screed 34 to spread and level the first rise of paving material within the trench T. The aforesaid spreading operation is repeated for each successive rise of paving material, the position of the screed being adjusted to a different lowered position for each successive rise until the trench T is paved to a level at or near the grade level of the shoulders S, S. The screed 34 is then adjusted to a raised position above the level of the skids 30, 30 and paving material is deposited to a level above the grade level of the existing pavement. The paving operation is completed by rolling the paving material to grade level.

I claim:

1. A trench paving device having a body assembly including a pair of laterally opposing sidewalls having front and rear end portions and bottom edges extending between said front and rear end portions, supporting means for maintaining said sidewalls in generally vertically disposed and rearwardly converging relation to each other with said bottom edges generally disposed within a common horizontal plane, ground engaging means for supporting said body assembly in straddling relation to a trench to be paved, a laterally disposed screed having a generally horizontally extending lower edge, said screed having an effective lateral dimension approximating the width dimension of the trench, mounting means for supporting said screed on said body assembly between said rear end portions for vertical adjustment relative to said sidewalls between raised positions wherein said lower edge is disposed above said common horizontal plane and lowered positions wherein said lower edge is disposed below said common horizontal plane, clamping means for releasably retaining said screed in a selected position of vertical adjustment relative to said sidewalls, and means for releasably securing said trench paving device in fixed position to a tool mounted on a construction vehicle and at the front end of the vehicle to move with the tool and relative to the vehicle in response to operation of manually operable controlling means carried by the vehicle.

2. A trench paving device as set forth in claim 1 wherein said body assembly includes adjusting means for varying the lateral spacing between said rear end portions.

3. A trench paving device as set forth in claim 2 wherein said adjusting means comprises said supporting means.

4. A trench paving device as set forth in claim 3 wherein said supporting means comprises a plurality of elongate telescopically adjustable cross members connected to and extending laterally between said sidewalls.

5. A trench paving device as set forth in claim 4 wherein said screed is selected from a plurality of screeds having different lateral width dimension.

6. A trench paving device as set forth in claim 1 wherein said attaching means comprises a pair of laterally spaced apart attaching members carried by said body assembly and defining rearwardly open slots for receiving an associated part of the tool therein and clamping means for releasably securing said attaching members to the associated part.

7. A trench paving device as set forth in claim 6 wherein said clamping means comprises a pair of clamping fasteners threadably engaged with said attaching members.

8. A trench paving device as set forth in claim 6 wherein each of said attaching members is connected to an associated one of said sidewalls.

9. A trench paving device as set forth in claim 1 wherein said ground engaging means comprises a pair of skids having bottom surfaces and projecting laterally outwardly in opposite directions from the lower portions of said sidewalls.

10. A trench paving device as set forth in claim 9 wherein each of said skids has at least one wear strip mounted on the bottom surface thereof and generally extending from the forward end toward the rear end of said bottom surface.

11. A trench paving device as set forth in claim 10 wherein said one wear strip is made from a material harder than the material from which said skids are made.

12. A trench paving device as set forth in claim 1 wherein said mounting means comprises a pair of opposing vertically extending and laterally inwardly open slots defined by said rear portions for receiving associated marginal portions of said screed therein.

13. A trench paving device as set forth in claim 12 wherein said clamping means comprises a pair of clamping fasteners threadably engaged with said side walls for clampingly engaging marginal edge portions of said screed within said slots.

14. A trench paving device as set forth in claim 13 wherein said screed has a vertically disposed portion and a horizontally disposed portion joined to said vertically disposed portion at said lower edge.

15. The combination comprising a construction vehicle having an earth moving bucket including a generally horizontally disposed lower lip, means for supporting said bucket at the front end of said vehicle for movement relative to said vehicle, and manually operable controlling means for moving said bucket to and maintaining said bucket in a selected position relative to said vehicle, and a trench paving attachment having a paver body assembly including a pair of laterally opposing side plates having front and rear end portions and bottom edges extending between said front and rear end portions, supporting means for maintaining said sidewalls in vertically rearwardly converging relation to each other, a laterally disposed screed supported between said rear end portions for vertical adjustment relative to said sidewalls, and means for releasably retaining said trench paving attachment in fixed position on said lower lip for movement with said bucket and relative to said vehicle in response to operation of said controlling means.

16. A trench paving device comprising a paver body assembly including a pair of opposing side plates, each of said plates having a front portion, a rear portion and a lower edge extending between said front and rear portions, supporting means for maintaining said side plates in vertically disposed and rearwardly converging relation to each other and for adjusting the lateral spacing between said side plates including a pair of telescopically adjustable cross members connected to upper portions of said side plates and extending laterally therebetween in parallel relation to each other, and clamping fasteners for releasably securing said telescopically adjustable cross members in selected positions of adjustment, a vertically adjustable screed mounted on said paver body assembly between said side plates, said screed plate being vertically adjustable relative to said side plates and having a horizontally disposed lower edge extending laterally between said side plates, means for releasably retaining said screed in selected positions of adjustment relative to said side plates, and attaching means for releasably retaining said trench paving device in fixed position on an associated loading bucket.

* * * * *